United States Patent [19]

Zeitlin et al.

[11] 4,280,986

[45] Jul. 28, 1981

[54] METHOD FOR SEPARATING METAL VALUES FROM SEA NODULES

[75] Inventors: Harry Zeitlin, Honolulu, Hi.; Quintus Fernando, Tucson, Ariz.

[73] Assignee: University Patents, Inc., Norwalk, Conn.

[21] Appl. No.: 169,549

[22] Filed: Jul. 17, 1980

Related U.S. Application Data

[63] Continuation of Ser. No. 676, Jan. 3, 1979, abandoned.

[51] Int. Cl.[3] ..... C01G 3/10; C01G 51/10; C01G 53/10; C01G 45/10

[52] U.S. Cl. ..... 423/41; 423/49; 423/150; 423/DIG. 4

[58] Field of Search ..... 423/DIG. 4, 41, 49, 423/150

[56] References Cited

U.S. PATENT DOCUMENTS

| | | | |
|---|---|---|---|
| 2,817,583 | 12/1957 | Schlacht et al. | 423/59 |
| 3,169,856 | 2/1965 | Mero | 423/DIG. 4 |
| 3,810,827 | 5/1974 | Kane et al. | 423/DIG. 4 |
| 3,869,360 | 3/1975 | Kane et al. | 423/DIG. 4 |

OTHER PUBLICATIONS

Brooks et al., "9th International Mineral Processing Congress," Prague, 1970.

*Primary Examiner*—Herbert T. Carter

[57] ABSTRACT

A process for separating metal values from sea nodules by sulfating the nodule ore under substantially dry conditions, followed by leaching of the sulfated ore; separation of the leaching solution from water-insoluble residue and recovery of the metal values from the leaching solution.

1 Claim, No Drawings

METHOD FOR SEPARATING METAL VALUES FROM SEA NODULES

This application is a continuation of our prior U.S. application Ser. No. 000,676 filed on Jan. 3, 1979, now abandoned.

This invention relates to an improved method of recovery of metal values from ferromanganese nodules, commonly referred to as sea nodules.

Sea nodules are aptly named in that they are found in the deep-sea beds and are primarily constituted of iron and manganese for which reasons names such as ferromanganese and manganiferous have been employed. In addition to iron and manganese, recoverable quantities of valuable metals such as Ni, Co, and Cu are also present and it is the presence of such metals which has led to intensified efforts to develop practical and economical processes for recovery of the said metal values from sea nodules. Nodule deposits can be found in all oceans but the Pacific Ocean remains the richest source with estimates of some 1.5 trillion metric tons of nodules present on the Pacific seafloor being replenished at the impressive rate of 10 million tons annually. The extraction and separation of copper, nickel, cobalt and manganese from sea nodules have proved to be an exceedingly complex metallurgical problem. Interestingly enough, Pacific Ocean nodules appear to be structurally different from, for example, Atlantic Ocean nodules, the differences probably being due to different structural makeup which accounts for a difference in reactivity.

Of particular attractiveness are processes predicated on sulfation of sea nodules with sulfur dioxide. U.S. Pat. No. 3,169,856 describes a process of treating sea nodules with aqueous solution of sulfur dioxide to selectively separate nickel from cobalt, the bulk of the Ni, Mn and Cu being solubilized and the Co remaining in the insoluble nodule ore, presumably the iron oxide matrix. U.S. Pat. No. 3,810,827 describes a sulfation process wherein the ore is treated with gaseous sulfur dioxide in the absence of oxygen and then leached with water to separate the water-soluble manganese sulfate from the solid residue, which was subsequently treated as by sulfation with $SO_2$ and $O_2$ followed by water-leaching to obtain the water-soluble salts of Cu, Ni and Co. U.S. Pat. No. 3,869,360 describes a sulfation process which involves sulfation of an aqueous slurry of sea nodules using sulfur dioxide and oxygen including oxidation of the iron content of the sea nodule to iron oxide, and leaching the ore with water to separate the water-soluble salts.

With these various processes of sulfation, however, only incomplete and inefficient recovery of the Ni, Co and Cu are realized and there still remains a need for an improvement in the efficiency of recovery of the said metals.

BRIEF DESCRIPTION OF THE INVENTION

This invention provides an improved process for recovery of metal values from sea nodules, which in its preferred form provides almost quantitative separation of manganese, cobalt and nickel values and extremely high recovery of copper values.

The invention is accomplished by contacting the ferromanganese nodule ore with sulfur dioxide in the presence of oxygen under substantially dry conditions after which the treated ore is leached with water and the resulting water solution, after separation of insolubles is employed in the separation and recovery of the respective metal values. To accomplish the substantially dry conditions required in the sulfation step, i.e., contact with sulfur dioxide and oxygen, the initial nodule ore which normally can contain up to about 30% water should be substantially dry to obtain the beneficial results of the present process.

In a preferred form of the invention, the sulfation step is accomplished at elevated temperatures, i.e., about 300° to about 600° C., where best results are observed.

To effect the present process, the substantially dry sea nodules are sulfated under substantially dry conditions to convert the metal values of the ore to soluble form with the exception of the iron values. Thus, the first step of the present process effects a separation of Mn, Co, Cu, Ni and other metals present in lesser amounts from the iron values of the ore. Only small amounts, if any, of the iron values are converted to soluble form under the conditions of the sulfation step of the present process. Under preferred conditions, as hereinafter described, the present process provides essentially quantitative separation of Mn, Co and Ni, and about 75% of Cu based on the initial content of the said metals in the sea nodule ore. Such high efficiency separation has not been previously attained by the known sulfation procedures.

The highly desirable and beneficial results of the present invention are apparently attributable to two factors in the sulfation step. The first of these factors is maintenance of the reaction system in a substantially dry condition, i.e., substantially free of water; and the second, the essential presence of oxygen. When oxygen is not present, i.e., when only sulfur dioxide is employed, in the sulfation step, less than 75% of the Mn, 10–15% of Co and Ni, and only traces of Cu could be separated from nodules sulfated in the absence of oxygen. When water is present, the efficiency and selectivity of separation is diminished.

DESCRIPTION OF PREFERRED EMBODIMENTS

The sea nodule ore selected for processing is preferably in finely-divided form in order to increase the efficiency of contact with the gaseous reactants, sulfur dioxide and oxygen. Thus, the ore can be comminuted as by pulverizing or powdering to a finely-divided state. For most purposes, standard mesh sizes of about 30–100 are found quite suitable although larger or even smaller size can be employed. The size of the particles will merely dictate the time required for reaction and is otherwise not critical.

The sea nodule ore must be substantially dry before contact with the sulfur dioxide and oxygen. Drying of the ore, preferably in finely-divided state for increased efficiency, is accomplished by heating at elevated temperatures to remove water contained therein, the usual water content amounts to about 30% by weight of the sea nodule ore. Heating is continued until constant weight prevails, as is usual practice in such operation. Normally, temperatures in the range of from about 300° C. to about 600° C. are preferred for the drying step. Typically, a sample of the ore is heated in an oven while a stream of inert gas, e.g., helium, nitrogen or air, is passed through the sample. When constant weight is attained, the sample is substantially free of contained water. While it is preferred to drive out all of the contained water, it is possible to use samples of ore which contain small amounts of water, up to about 1–2% by weight based on the ore weight, which amounts of water can be driven out of the sample in the pre-heating to reaction temperature.

In a preferred form of the invention, the sample of ore is heated to the reaction temperature to remove contained water, i.e., until constant weight is attained, and is then reacted with the gaseous sulfation mixture.

For all purposes, the sample of ore should be "substantially free of water" and, as employed herein and in the appended claims, by this is meant that the sample should contain not more than 1% by weight of water based on the total sample weight.

The sulfation reaction, i.e., contact with sulfur dioxide and oxygen is to be carried out under substantially dry conditions by which is meant water should be preferably totally excluded from the reaction system but can be tolerated up to a level of about 1% by weight of the reaction system. Thus, minor amounts of water, i.e., less than 1% by weight, can be tolerated without significant effect on the reaction.

Any source of sulfur dioxide gas can be employed in the present process and the gas is dried before it enters the reaction zone. Conventional drying of the reaction gas can be employed where greater than 1% by weight of water, e.g., as water vapor, is present in the gas. The oxygen employed, which is dried conveniently along with the sulfur dioxide, or separately as dried, can be pure oxygen gas or air or mixtures thereof. The amounts of each gas added to the reaction zone is not critical since, being gaseous and inexpensive, the gases can be used in excess of the stoichiometric quantities required. The reactive gases may be employed as such or diluted with carrier gas such as helium. Thus, the sulfur dioxide and oxygen gases are added until take-up of the reacting gas ceases. Normally, the take-up of sulfur dioxide gas will vary somewhat with temperature so that, for example, the ore sample can absorb 379 mg. of gas per gram of sample at 300° C. whereas at higher temperatures, the absorption will increase and dramatically at certain temperature ranges. For example, at 350° C., 447 mg/g. is the absorption value, while at 400° C., 493 mg/g., but at 500° C. and above the up take of gas decreases, e.g., at 600° C., 379 mg/g. The optimum absorption of gas occurs within the range of from about 375° C. to about 425° C., and best results are obtained at optimum absorption of sulfur dioxide.

Accordingly, the temperature of the sulfation reaction is preferably that at which absorption of sulfur dioxide occurs at a reasonable rate, i.e., between about 300° C. and about 600° C., with the preferred range being from about 375° to about 400° C. Of course, sulfur dioxide absorption does occur at lower or higher temperatures but the reaction is slower due to lower absorption of gas, and such temperatures therefore are not preferred.

Conveniently, as sulfation of the ore proceeds, the original ore which is dark colored, usually dark brown, lightens to eventually a light tan color at full sulfation so that the process is conveniently monitored by visual inspection of the color of the sample. Completeness of sulfation is indicated by no further change in the color of the reaction mixture.

After the sulfation reaction step is concluded, the reaction mixture is then treated with water to dissolve the water-soluble salts therefrom. For this purpose, the reaction mixture is usually pulverized into finely-divided state if the particles have coalesced during the sulfation step. This step, commonly referred to as leaching with water, can be accomplished with hot or cold water, as desired, depending on the concentration desired in the resulting solution. The leach water may contain sources of complex-formers or ligands to complex the various metal ions contained in the leach solution, permitting separation of these metal ions, e.g., based on differential solubility in organic solvents of the said complexes.

The leach solution should be separated from insoluble residues, mostly iron values, from the ore. The separation method is not critical and can be effected by any of the usual methods of separation of solids from liquid phases, e.g., filtration, centrifugation and decantation.

After separation, the metal values contained in the leach solution can be separated and thereafter recovered by art-recognized procedures, e.g., electrodeposition of the separated metal ions from solution.

Separation of the metal ions from the aqueous leach solution can be brought about in accordance with the procedures described in the aforesaid U.S. Pat. Nos. 3,169,856; 3,810,827; and 3,869,360, the recovery and separation disclosures of which are incorporated herein by reference.

A specific method which can be employed follows. The leach solution is adjusted to alkaline pH with ammonia to form ammine complexes of the contained metal ions. From this solution, the copper, nickel and cobalt can be successively extracted at successively higher pH values obtained by stepwise addition of ammonia employing known chelating agents and extraction techniques employing organic solvents. For example, a commercial chelating agent (LIX 64N) consisting of a mixture of 2-hydroxy-5-nonylbenzophenone oxime and 5,8-diethyl-7-hydroxy-6-dodecane oxime dissolved in kerosene (1.5% solution) can be used to effect the separation which is accomplished by raising the pH stepwise and extracting the so-adjusted solution with the kerosene solution of chelating agent. Successively, the copper, nickel and cobalt were removed leaving manganese in solution.

A variety of factors including stability of complexes, distribution coefficients between aqueous and organic phases, acid dissociation constants of ligands, and concentrations of various species control the extraction of the various metals. Thus, the pH for optimum results will vary with the chelating agent selected as well as the aforesaid factors.

The metal values can be separated from the complexes by methods known to the art, as by springing with a mineral acid such as sulfuric in the known manner. The resulting aqueous solutions can then be used for electrodeposition of the metal from solution by known methods.

The following examples further illustrate the invention.

EXAMPLE I

Ferromanganese nodules used in this study were collected from the Pacific Ocean, longitude 24°43'W and latitude 19°49'N. The air dried nodules were crushed and sieved in order to obtain representative samples of 60–100 mesh particle size. All gased, chemicals, and reagents were of analytical grade. Water was distilled and deionized prior to use. Glassware was pretreated by soaking in nitric aciid overnight and rinsing thoroughly with water. Atomic absorption analyses were carried out with a Beckman atomic absorption spectrophotometer Model 495 equipped with the appropriate single-element hollow cathode lamps. Standards were supplied by SPEX Industries, Inc. Nodule samples were drhydrated prior to all subsequent treatment.

The procedure adopted consisted of heating the samples in a furnace at 500° C. for 24 hours while helium, the carrier gas, was passed through the sample column. The weight loss of 31.0% was assumed to be the moisture present in the air-dried nodule sample. In order to verify the adequacy of the dehydration treatment a second sample was dried for the same time period at 300° C. The weight loss was 30.8%, in close agreement with the 500° C. sample and indicated that dehydration was essentially completed in both cases.

TABLE I

| | Metal | | | | | |
|---|---|---|---|---|---|---|
| | Mn | Fe | Ca | Ni | Cu | Co |
| Concentration (% w/w) | 23.20 | 11.20 | 1.25 | 1.05 | 0.72 | 0.35 |

*Each concentration represents the average of five replicates.

TABLE 2

| Temp. (°C.) | Metal Concentrations Extracted from Manganese Nodules Sulfated in the absence of $O_2$ (% w/w) | | | | | | Metal Concentrations Extracted from Manganese Nodules Sulfated in the Presence of $O_2$ (% w/w) | | | | | |
|---|---|---|---|---|---|---|---|---|---|---|---|---|
| | Mn | Fe | Cu | Ni | Co | $SO_2$ Sorption (ml/g) | Mn | Fe | Cu | Ni | Co | $SO_2$ Sorption (ml/g) |
| 300 | 22.8 | ND | 2.0 | 17.8 | 14.1 | 25 | 37.9 | ND | ND | 11.2 | 12.8 | 26 |
| 350 | 45.7 | " | 2.6 | 16.0 | 41.4 | 137 | 63.1 | " | " | 4.6 | 16.3 | 27 |
| 375 | 98.1 | 4.4 | 63.0 | 91.6 | 100.6 | 218 | 72.8 | " | 0.2 | 7.6 | 12.4 | 30 |
| 400 | 104.2 | 2.0 | 75.5 | 88.5 | 97.4 | 139 | 62.8 | " | ND | 3.3 | 10.8 | 26 |
| 500 | 94.0 | 1.5 | 60.0 | 61.3 | 77.9 | 104 | 68.8 | " | " | 8.1 | 10.4 | 27 |
| 600 | 81.0 | T | 15.9 | 18.6 | 46.8 | 69 | 24.4 | " | " | 1.2 | 1.2 | 27 |

ND = None Detected
T = Trace

Dehydrated samples were analyzed (atomic absorption analysis) for Co, Cu, Ni, Mn and Fe and the concentration expressed on a weight percentage basis. The results are given in Table I in which the concentration reported for each metal ion represents the average of five replicates. The sulfur $L_{II,III}$ X-ray emission spectra of sulfated manganese nodules and $MnSO_4.H_2O$ were obtained with a Phillips vacuum spectrograph equipped with a soft X-ray excitation source ($CK_a$) and a subatmospheric pressure proportional counter using propane gas at 50 torr.

Sulfation tests with manganese nodules were carried out by employing a flow-through gas system over a temperature range 300°–600° C. The instrument used was a Lindberg single stage furnace equipped with a platinel-II and chromel coupled temperature controller with an accuracy of ±0.5° C. The temperature controller was calibrated against a chromel-alumel thermocouple connected to a X-Y recorder. A vycor glass column packed with approximately 2.50 g of the nodules was inserted into the furnace and maintained at the desired temperature overnight prior to introducing $SO_2$. Flow rates of gases were measured by Linde-150 Series flow meters which had been factory calibrated (±1%) with the specific gases. A known quantity of $SO_2$ gas was introduced into the column at a flow rate of 50 ml/min. and the amount not absorbed by the nodules was carried into a gas impinging bottle containing 0.1 M NaOH, and determined titrimetrically. Helium was used throughout as a carrier gas in the study. The identical system was used for the sulfation reaction in the presence of $O_2$ by introducing into the sample-packed column a mixture of $SO_2$ and $O_2$ at varying temperatures. The sulfated manganese nodules were leached with water by heating on a hot plate at 90° C. for three hours with continuous magnetic stirring and the filtered aqueous extracts analyzed by atomic absorption spectrophotometry. The results shown in Table 2 provide the percent recovery of each metal ion (w/w) as a function of temperature both in the presence and absence of $O_2$ together with $SO_2$ sorption capacities.

The results of the atomic absorption analyses for the metals extracted from dehydrated nodules treated with $SO_2$ at varying temperatures in the presence of $O_2$ show that recovery of metals is in good agreement with the quantity of $SO_2$ absorbed in the gas-solid reaction (Table 2). The data also show that at elevated temperatures $O_2$ plays a critical role in the absorption of $SO_2$. It is clear that the degree to which metal salts are extracted from sulfated nodules with water depends upon the conditions under which sulfation is carried out. The amount of $SO_2$ absorbed by the nodules in the presence of $O_2$ at 300° C. is about the same (379 mg/g) as that absorbed by the nodules in the absence of $O_2$ at the same temperature. The $SO_2$ absorption increases dramatically, to 447 mg/g at 350° C. and to 493 mg/g at 400° C. in the presence of $O_2$. The extent of sulfation also increases in a similar manner. The $SO_2$ uptake decreases at temperatures above 500° C. to about 379 mg/g at 600° C. It is significant that when nodules are treated with an $SO_2$—$O_2$ mixture at the 375°–425° C. range manganese, cobalt, and nickel are extracted quantitatively and approximately 75% of the copper is recovered. At higher and lower temperatures using the same gas mixture the extraction of the water soluble metal sulfates decreased. If oxygen is excluded the results are different. There is very little apparent dependency of metals extracted on the temperature of sulfation and manganese alone is extracted to a significant extent but not quantitatively. It is also striking that in no case studied under these conditions are Fe and Cu to be found in the aqueous extracts following treatment of the nodules with $SO_2$ in the absence of $O_2$. There is a sharp contrast in the behavior of Cu since this metal is extracted (60–75%) when the sulfation is carried out in the 375°–500° C. range in the presence of $O_2$ and only negligibly in the absence of $O_2$. The sulfation and recovery studies were repeated with a second sample of Pacific ferromanganese nodules obtained from a different location. Similar results are obtained and confirm the 375°–400° C. range as being optimum for the recovery of Mn, Co, Ni, and Cu when the sulfation of nodules is carried out in the presence of $O_2$.

What is claimed is:

1. In a process for separating manganese, cobalt, copper, and nickel metal values from ferromanganese sea nodule ores comprising the steps of:

(a) contacting said nodule ore with sulfur dioxide in the presence of oxygen to convert said metal values to water-soluble salts;

(b) leaching the product of step (a) with water to form a solution of said water-soluble salts;

(c) separating water-insoluble residue from the solution of step (b); and (d) separating and recovering said metal values from the solution obtained from step (c);

the improvement providing essentially quantitative recovery of manganese, cobalt, and nickel values and about 75% recovery of copper values based on the initial content of said metal values in said nodule ore, consisting of preheating said nodule ore in finely-divided state at elevated temperature until substantially dry prior to said contacting step, and conducting said contacting step with said nodule ore in substantially dry state under substantially dry conditions at a temperature within the range of from about 375° to about 425° C.

* * * * *

UNITED STATES PATENT AND TRADEMARK OFFICE

CERTIFICATE OF CORRECTION

PATENT NO. : 4,280,986

DATED : July 28, 1981

INVENTOR(S) : Harry Zeitlin, et al.

It is certified that error appears in the above—identified patent and that said Letters Patent is hereby corrected as shown below:

Column 3, Line 26, "dried" should read -- desired --.

Column 4, Line 38, "were" should read -- are -- .

Signed and Sealed this

Tenth Day of November 1981

[SEAL]

*Attest:*

GERALD J. MOSSINGHOFF

*Attesting Officer*

*Commissioner of Patents and Trademarks*